US008942579B2

(12) United States Patent
Suenami

(10) Patent No.: US 8,942,579 B2
(45) Date of Patent: Jan. 27, 2015

(54) IMAGE FORMING APPARATUS INCLUDING DEVELOPING UNIT

(71) Applicant: Kyocera Document Solutions Inc., Osaka (JP)

(72) Inventor: Koji Suenami, Osaka (JP)

(73) Assignee: Kyocera Document Solutions, Inc., Osaka (JP)

( * ) Notice: Subject to any disclaimer, the term of this patent is extended or adjusted under 35 U.S.C. 154(b) by 47 days.

(21) Appl. No.: 13/782,815

(22) Filed: Mar. 1, 2013

(65) Prior Publication Data

US 2013/0243450 A1 Sep. 19, 2013

(30) Foreign Application Priority Data

Mar. 14, 2012 (JP) ..... 2012-057161

(51) Int. Cl.
*G03G 15/08* (2006.01)
*G03G 15/00* (2006.01)

(52) U.S. Cl.
CPC ..... *G03G 15/0824* (2013.01); *G03G 15/0849* (2013.01); *G03G 15/556* (2013.01)
USPC ..... 399/27; 399/30; 399/258

(58) Field of Classification Search
USPC ..... 399/27, 30
See application file for complete search history.

(56) References Cited

U.S. PATENT DOCUMENTS 5,253,020 A * 10/1993 Matsushita et al. ..... 399/30
6,526,252 B1 * 2/2003 Itoh et al. ..... 399/359
7,149,437 B2 * 12/2006 Okubo ..... 399/27
7,333,739 B2 * 2/2008 Miyata ..... 399/27
7,352,977 B2 * 4/2008 Nakano et al. ..... 399/30
2003/0202806 A1 * 10/2003 Katoh et al. ..... 399/27
2003/0228164 A1 * 12/2003 Katoh ..... 399/30
2006/0098998 A1 * 5/2006 Yamada et al. ..... 399/53
2006/0159474 A1 * 7/2006 Suzuki et al. ..... 399/27
2006/0251983 A1 * 11/2006 Muramatsu et al. ..... 430/120
2007/0036566 A1 * 2/2007 Takeuchi et al. ..... 399/27
2008/0019712 A1 * 1/2008 Tanaka et al. ..... 399/30
2008/0124107 A1 * 5/2008 Takeuchi et al. ..... 399/59
2008/0152366 A1 * 6/2008 Endou et al. ..... 399/27
2008/0273885 A1 * 11/2008 Koizumi et al. ..... 399/30
2009/0034995 A1 * 2/2009 Mochizuki ..... 399/27
2009/0041520 A1 * 2/2009 Takeuchi et al. ..... 399/359

(Continued)

FOREIGN PATENT DOCUMENTS

JP H03-269468 A 12/1991
JP 2006-208578 A 8/2006

(Continued)

*Primary Examiner* — David Bolduc
(74) *Attorney, Agent, or Firm* — Knobbe Martens Olson & Bear, LLP

(57) ABSTRACT

The present disclosure relates to an image forming apparatus including: a developing unit; a developer supply unit; a toner density detecting unit; a mode setting unit; a first supply control unit; a second supply control unit; and a second standard value setting unit. The toner density detecting unit detects toner density. The mode setting unit, when toner density detected by the toner density detecting unit is less than a first standard value and a second standard value that is lower than the first standard value or more, sets a first developer supply mode as a mode for supplying developer to the developing unit and when the toner density detected by the toner density detecting unit is less than the second standard value, sets a second developer supply mode as a mode for supplying developer to the developing unit.

2 Claims, 5 Drawing Sheets

(56) References Cited

U.S. PATENT DOCUMENTS

| | | | | |
|---|---|---|---|---|
| 2009/0060534 | A1* | 3/2009 | Murauchi et al. | 399/30 |
| 2009/0214232 | A1* | 8/2009 | Murauchi et al. | 399/30 |
| 2009/0214233 | A1* | 8/2009 | Murauchi et al. | 399/30 |
| 2009/0232525 | A1* | 9/2009 | Izumi et al. | 399/27 |
| 2010/0046971 | A1* | 2/2010 | Zollner et al. | 399/53 |
| 2010/0061750 | A1* | 3/2010 | Okada | 399/55 |
| 2010/0104300 | A1* | 4/2010 | Shinohara | 399/43 |
| 2011/0044705 | A1* | 2/2011 | Akashi et al. | 399/27 |
| 2011/0305468 | A1* | 12/2011 | Fujiwara | 399/27 |
| 2012/0008969 | A1* | 1/2012 | Mitamura | 399/53 |

FOREIGN PATENT DOCUMENTS

| | | | | |
|---|---|---|---|---|
| JP | 2008-102411 | A | | 5/2008 |
| JP | 2010217379 | A | * | 9/2010 |

* cited by examiner

IMAGE FORMING APPARATUS INCLUDING DEVELOPING UNIT

INCORPORATION BY REFERENCE

This application is based upon and claims the benefit of priority from the corresponding Japanese Patent Application No. 2012-057161, filed in the Japan Patent Office on Mar. 14, 2012, the entire contents of which are incorporated herein by reference.

BACKGROUND

The present disclosure relates to an image forming apparatus including a developing unit which develops an electrostatic latent image formed by an electrophotographic process.

In an image forming apparatus using the electrophotographic process such as a copying machine, a printer, facsimile, or the like, toner is supplied to an electrostatic latent image formed on the surface of an image bearing member such as a photosensitive drum to develop (visualize) the electrostatic latent image in the form of a toner image and the toner image is transferred to and fixed on a recording medium.

In such an image forming apparatus, when the toner image is formed on the surface of a photosensitive drum, toner is consumed. Thus, to keep the toner density (ratio of toner with respect to carrier) of developer stored in the developing unit on a constant level, the developing unit is supplied with toner from a toner cartridge. However, when images having a high coverage rate are printed continuously, the density of toner stored in the developing unit decreases extremely, so that formed images may be weak or image unevenness may occur in the images.

When the toner density drops below a control standard value (hereinafter also referred to as "toner density control standard value") corresponding to the coverage rate of images, printing is stopped temporarily and the toner is supplied while developer in the developing unit is agitated. Then, when the toner density in the developing unit is restored to the toner density control standard value, printing is restarted. Such an image forming apparatus has been proposed.

Further, a technology of inhibiting a drop in the toner density in the developing unit has been proposed by changing the toner density control standard value when printing images having a high coverage rate are printed continuously.

However, the former technology has a possibility that when images are printed continuously regardless of the coverage rate, supply of toner to meet consumption of toner may be delayed. Further, according to the former technology, when an image having a high coverage rate is changed to an image having a low coverage rate, there is a possibility that print action may be stopped to execute supply of toner although the print action does not have to be stopped.

Even for images having a high coverage rate, it is not always necessary to stop the print action and supply toner if print speed is slow. However, the former technology has a possibility that even in this case, the print action may be stopped to supply toner.

On the other hand, according to the latter technology, once the toner density control standard value is raised due to continuous printing of images having a high coverage rate, the toner density may be raised too much when images having an ordinary coverage rate are printed. Thus, there is a possibility that fogging on a white background (adhesion of improperly charged toner) may be generated.

SUMMARY

The present disclosure relates to an image forming apparatus including: an image bearing member; an electrostatic latent image forming unit; a developer accommodating unit; a developing unit; a developer supply unit; a toner density detecting unit; a mode setting unit; a first supply control unit; a second supply control unit; and a second standard value setting unit. An electrostatic latent image is formed on the surface of the image bearing member. The electrostatic latent image forming unit forms an electrostatic latent image on the surface of the image bearing member. The developer accommodating unit accommodates developer containing at least toner. The developing unit supplies toner to the image bearing member and develops the electrostatic latent image as toner image. The developer supply unit supplies the developer accommodated in the developer accommodating unit to the developing unit. The toner density detecting unit detects toner density in the developing unit. The mode setting unit, when toner density detected by the toner density detecting unit is less than a first standard value and a second standard value that is lower than the first standard value or more, sets a first developer supply mode as a mode for supplying developer to the developing unit and, when the toner density detected by the toner density detecting unit is less than the second standard value, sets a second developer supply mode as a mode for supplying developer to the developing unit. The first supply control unit, when the first developer supply mode is set by the mode setting unit, controls the developer supply unit to supply developer accommodated in the developer accommodating unit to the developing unit. The second supply control unit, when the second developer supply mode is set by the mode setting unit, interrupts development of the electrostatic latent image by the developing unit and controls the developer supply unit to supply the developer accommodated in the developer accommodating unit to the developing unit. The second standard value setting unit calculates toner consumption speed in the developing unit and sets the second standard value corresponding to the toner consumption speed.

DETAILED DESCRIPTION

Figure 1:
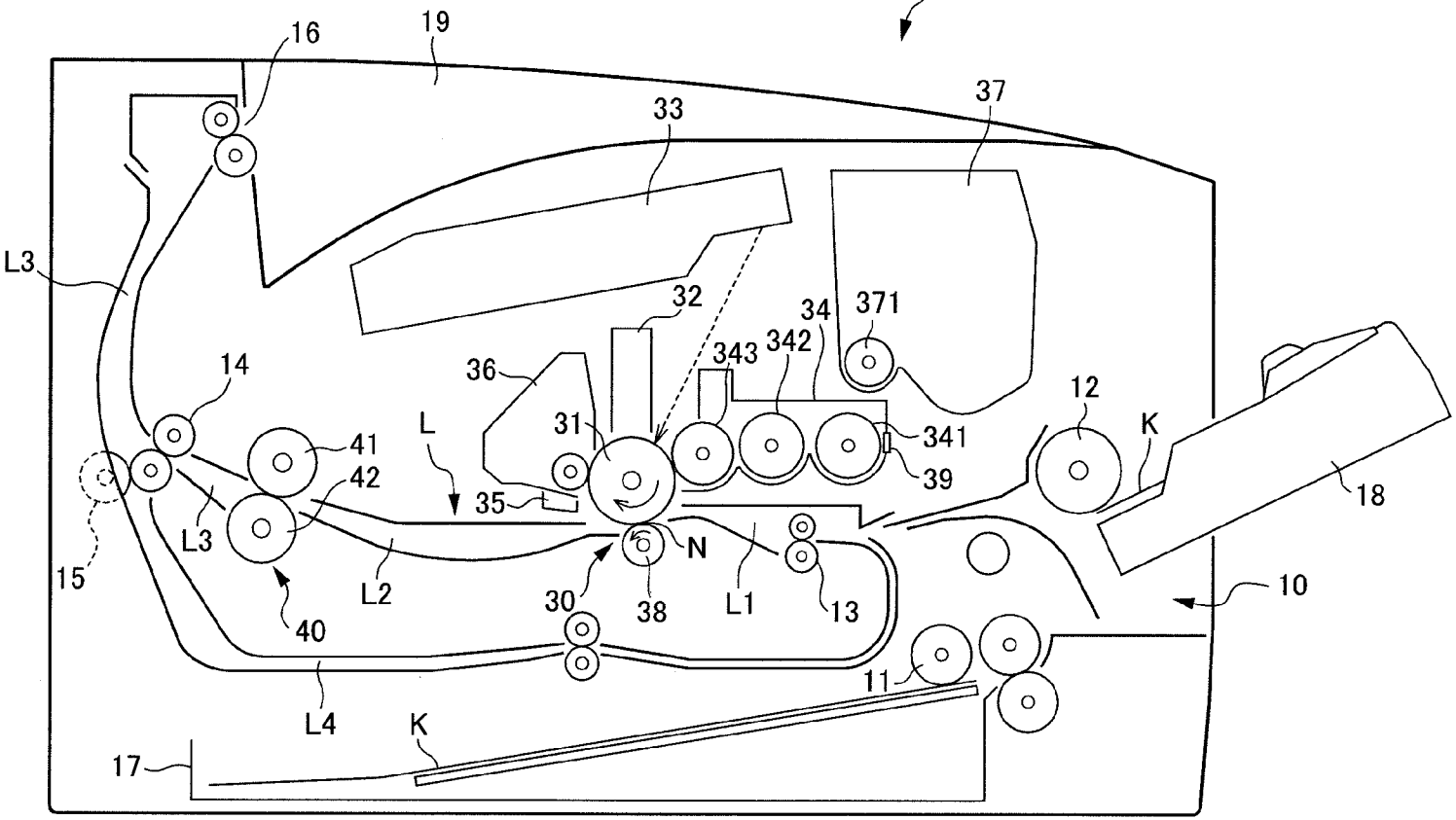
FIG. 1 is a diagram for describing an entire structure of a printer 1 according to an embodiment.

Hereinafter, a printer according to an embodiment of the image forming apparatus of the present disclosure will be described with reference to the accompanying drawings. First, an entire structure of a printer 1 will be described. FIG. 1 is a diagram for describing the entire structure of the printer 1 according to the present embodiment.

As shown in FIG. 1, the printer 1 of the present embodiment includes a paper feeding unit 10, an image forming unit 30, and a fixing unit 40 as major components. In the present embodiment, two-component developer composed of toner and carrier is called "developer" depending on the circumstance.

The paper feeding unit 10 includes a first feeding roller 11, a second feeding roller 12, a registration roller pair 13, a first roller pair 14, a second roller pair 15, and a paper discharge unit 16. A conveyance path L in which a sheet K is conveyed includes a first conveyance path L1, a second conveyance path L2, a third conveyance path L3, and a fourth conveyance path L4. The first conveyance path L1 constitutes a portion of the conveyance path L from the first feeding roller 11 or the second feeding roller 12 to the image forming unit 30 (transfer nip N which will be described below). The second conveyance path L2 constitutes a portion of the conveyance path L from the image forming unit 30 (transfer nip N which will be described below) to the fixing unit 40. The third conveyance path L3 constitutes a portion of the conveyance path L from the fixing unit 40 to the paper discharge unit 16. The fourth conveyance path L4 constitutes a portion of the conveyance path L which brings back a sheet K discharged from the fixing unit 40 to the registration roller pair 13.

The first feeding roller 11 supplies the sheet K (transfer target material) accommodated in a sheet cassette 17 to the first conveyance path L1. The second feeding roller 12 supplies the sheet K placed in a manual feeding tray 18 to the first conveyance path L1. The registration roller pair 13 supplies the sheet K conveyed through the first conveyance path L1 to the transfer nip N formed between the photosensitive drum 31 and a transfer roller 38. The registration roller pair 13 conveys the sheet K or stops conveyance of the sheet K to transfer a toner image formed on the photosensitive drum 31 to the sheet K.

The registration roller pair 13 corrects skew of the sheet K (oblique feeding of the sheet). The first roller pair 14 is provided on the third conveyance path L3 and conveys the sheet K discharged from the fixing unit 40 to a paper discharge unit 16 side. The second roller pair 15 conveys the sheet K conveyed to the paper discharge unit 16 side by the first roller pair 14 to the fourth conveyance path L4. The paper discharge unit 16 discharges the sheet K on which a toner image is fixed out of the printer 1. A discharged paper accumulation unit 19 is formed outside the printer 1 adjacent to the paper discharge unit 16. The sheets K discharged from the paper discharge unit 16 are accumulated on the discharged paper accumulation unit 19.

The image forming apparatus 30 is an apparatus for forming a toner image. The image forming unit 30 includes the photosensitive drum 31 which serves as an image bearing member, a charging unit 32, a laser scanner unit 33 which serves as an electrostatic latent image forming unit, a developing unit 34, a discharging device 35, a cleaning unit 36, a toner cartridge 37 which serves as a developer storage unit, and the transfer roller 38. In the present embodiment, the laser scanner unit 33 operates as part of the image forming unit 30.

Toner is supplied to the photosensitive drum 31 from a toner layer of a developing roller 343 (toner carrying member), so that an image (toner image) is formed along an electrostatic latent image formed on the surface thereof. The charging unit 32, the laser scanner unit 33, the developing unit 34, and the cleaning unit 36 are arranged around the photosensitive drum 31 in succession from the upstream to the downstream in a rotation direction of the photosensitive drum 31.

The charging unit 32 charges the surface of the photosensitive drum 31 equally negatively (with minus polarity) or positively (with plus polarity).

The laser scanner unit 33 is disposed apart from the surface of the photosensitive drum 31. The laser scanner unit 33 irradiates the surface of the photosensitive drum 31 with laser beam continuously or intermittently based on image data (original image) transmitted from an external device arranged outside (e.g., personal computer). When the laser beam is projected to the photosensitive drum 31 from the laser scanner unit 33, charges on an exposed portion of the surface of the photosensitive drum 31 are removed so that an electrostatic latent image corresponding to the original image is formed.

The developing unit 34 applies monochrome (usually, black) toner to an electrostatic latent image formed on the surface of the photosensitive drum 31 and develops the electrostatic latent image as a toner image. The developing unit 34 includes an agitation roller 341, a magnetic roller 342 which serves as a developer carrying member, a developing roller 343 which serves as a toner carrying member. The agitation roller 341, the magnetic roller 342, and the developing roller 343 are supplied with each rotation force by each dedicated drive motor (not shown) connected to a roller shaft thereof. A toner density sensor 39 which serves as a toner density detecting unit is provided inside of the developing unit 34.

The developing unit 34 is a touch-down type developing unit. In the developing unit 34, magnetic brush is formed using magnetic force on the surface of the magnetic roller 342 and with toner supplied to the developing roller 343 from the magnetic brush, toner layer is formed on the surface of the developing roller 343. Then, the developing unit 34 develops an electrostatic latent image formed on the surface of the photosensitive drum 31 by supplying the toner layer formed on the developing roller 343 to the photosensitive drum 31. Consequently, a toner image is formed on the surface of the photosensitive drum 31.

The agitation roller 341 agitates developer supplied from a toner supply unit 371 (which will be described later). Static electricity is generated in the developer agitated by the agitation roller 341. In consequence, its carrier is charged negatively and the toner is charged positively. In addition, toner adheres to the carrier due to electrostatic force.

The magnetic roller 342 is constituted of a magnetic sleeve made of a cylindrical non-magnetic member. The magnetic sleeve is supported rotatably in a predetermined direction. A plurality of magnetic members (not shown) are arranged within the magnetic sleeve. The magnetic roller 342 holds developer with its magnetic force. Magnetic brush is formed on the surface of the magnetic roller 342 with the carrier contained in the developer. First bias voltage is applied to the magnetic roller 342 by a first voltage applying unit (not shown).

Part of the developer supplied to the developing unit 34 from the toner cartridge 37 (described below) is agitated by the agitation roller 341 and after that, held on the surface of the magnetic roller 342 due to magnetic force. Part of the developer held on the surface of the magnetic roller 342 forms the magnetic brush (developer layer) (not shown).

The developing roller 343 is constituted of a developing sleeve made of a cylindrical non-magnetic member. A plurality of magnetic members are arranged within the developing roller 343. The developing roller 343 is driven such that a rotation direction of the developing sleeve is opposite to a rotation direction of the magnetic roller 342 at a position opposed to the surface of the photosensitive drum 31.

Toner layer (not shown) is formed on the surface of the developing roller 343 using toner supplied from the magnetic brush of the magnetic roller 342 (developer carrying member). More specifically, only toner is moved to the surface of the developing roller 343 from the magnetic brush in which the thickness of the toner layer is restricted by a layer thickness restricting blade (not shown) of the magnetic roller 342 and toner layer is formed there. Second bias voltage is applied to the developing roller 343 by a second voltage applying unit (not shown).

A toner density sensor 39 detects toner density in the developing unit 34. The toner density sensor 39 of the present embodiment is a magnetic permeability sensor which detects magnetic permeability of developer accommodated in the developing unit 34 as toner density. The toner density sensor 39 sends a voltage value corresponding to the magnetic permeability of the developer accommodated in the developing unit 34 to a control unit 90. In a following description, toner density value TN of a voltage value corresponding to the magnetic permeability of developer is called "toner density value TN detected by the toner density sensor 39".

After image transfer is performed, the discharging device 35 discharges the surface of the photosensitive drum 31 (removes electric charge) by irradiating the surface of the photosensitive drum 31 with light.

After the surface of the photosensitive drum 31 is discharged by the discharging device 35, the cleaning unit 36 removes toner and the like remaining on the surface of the photosensitive drum 31.

The toner cartridge 37 stores two-component developer containing toner and carrier. A toner supply unit 371 is provided as a developer supply unit within the toner cartridge 37. The toner supply unit 371 is a unit which supplies developer accommodated in the toner cartridge 37 to the developing unit 34. The toner supply unit 371 and the developing unit 34 are connected via a toner supply path (not shown). The toner supply unit 371 is connected electrically with the control unit 90 (which will be described below). The amount of developer supplied from the toner supply unit 371 to the developing unit 34 is controlled by a drive signal transmitted from the control unit 90 to the toner supply unit 371.

A sheet K is sent in between the transfer roller 38 and the photosensitive drum 31, so that a toner image formed on the surface of the photosensitive drum 31 is transferred to the sheet K. Transfer bias is applied to the transfer roller 38 by a transfer bias applying unit (not shown) to transfer toner image formed on the surface of the photosensitive drum 31 to the sheet K.

The fixing unit 40 includes a heating rotating body 41 and a pressure rotating body 42. The heating rotating body 41 and the pressure rotating body 42 nip the sheet K after the toner image is transferred thereto and fix the toner to the sheet K by melting and pressurizing the toner.

Figure 2:
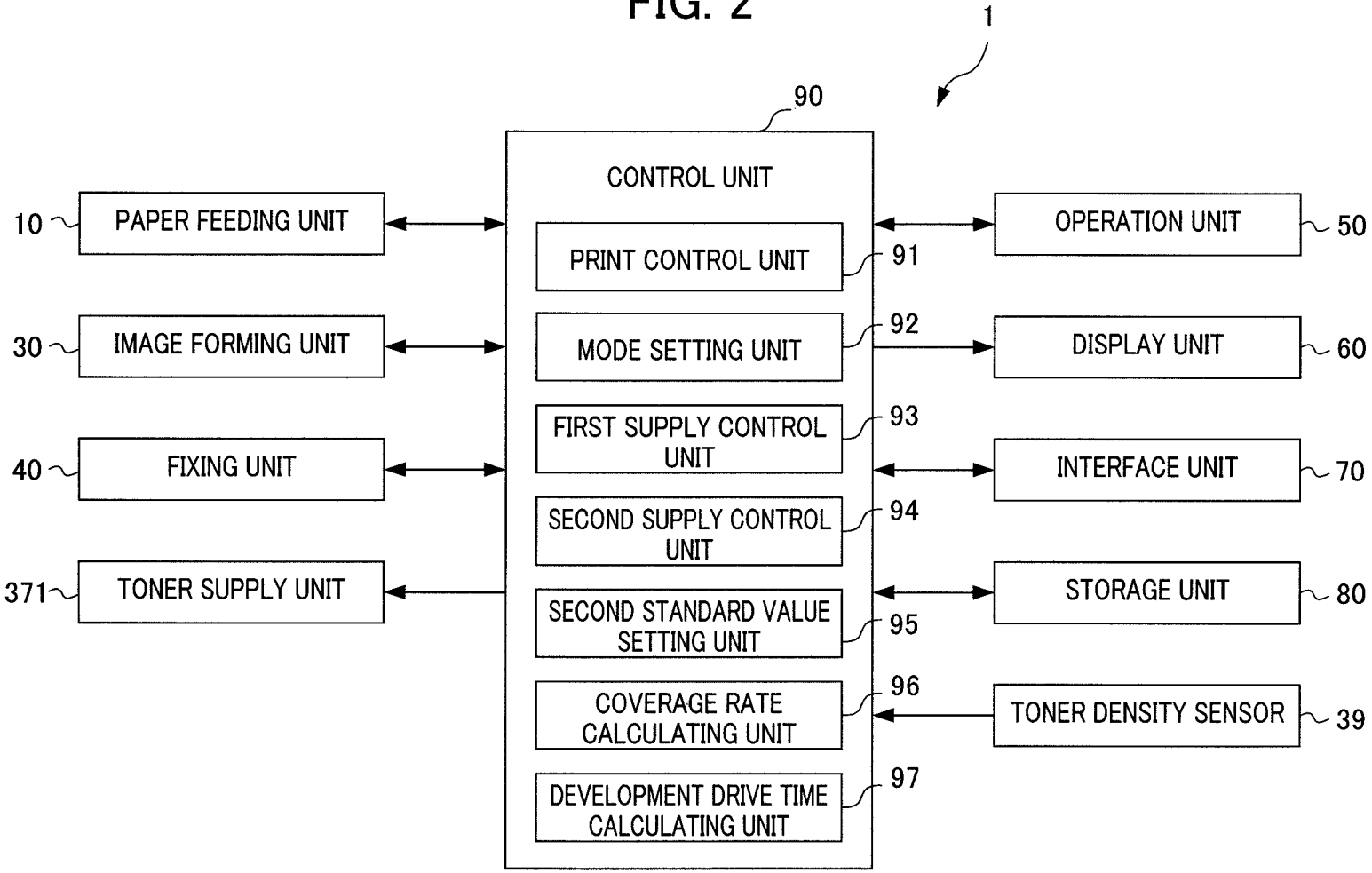
FIG. 2 is a block diagram showing a functional configuration of the printer 1.

Next, a functional configuration of the printer 1 of the present embodiment will be described. FIG. 2 is a block diagram showing a functional configuration of the printer 1. Description of a structure which has been already described with reference to FIG. 1 is omitted if it is appropriate.

As well as the above-described components (paper feeding unit 10, image forming unit 30 and fixing unit 40), the printer 1 further includes an operation unit 50, a display unit 60, an interface unit 70, a storage unit 80, a control unit 90, and a voltage applying unit (not shown).

The operation unit 50 has a plurality of keys (not shown). These plural keys are operated to change setting of the printer 1 or reset a job, for example. When any key is operated, the operation unit 50 transmits a signal corresponding to an operated key to the control unit 90.

As well as a setting mode, sheet size, number of prints and an output destination, the display unit 60 displays a message saying that toner is being supplied, a message saying that the remaining amount of developer stored in the toner cartridge 37 is small and a message saying that no sheet K has been accommodated in the sheet cassette 17.

The interface unit 70 is connected to an external device placed outside the printer 1, for example, a personal computer by wire (or wirelessly). The interface unit 70 has a function of acquiring image data of an electrostatic latent image formed on the surface of the photosensitive drum 31. Image data sent from the above-mentioned personal computer is received by the interface unit 70 and stored in the storage unit 80 (which will be described below).

The storage unit 80 is constituted of a hard disk or semiconductor memory. The storage unit 80 stores image data received from a personal computer temporarily. The storage unit 80 stores a control program for use in the printer 1 and data for use by this control program (e.g., first standard value $TN_{th1}$, second standard value $TN_{th2}$, toner density value TN).

The control unit 90 includes a CPU, RAM and ROM. The RAM is a storage device having a function of storing various kinds of data temporarily and a function of serving as a work area for arithmetic operation. The ROM is a storage device having a function as a flash memory which stores various kinds of programs. The CPU is an arithmetic unit which reads and executes a program from the ROM. The CPU exchanges data with the RAM and ROM via data bus (not shown). The CPU executes a program read out from the ROM to execute a processing corresponding to the program. In addition, the CPU has a function as a timer which counts time.

The control unit 90 controls the paper feeding unit 10, the image forming unit 30, the fixing unit 40, and the display unit 60.

The control unit 90 includes a print control unit 91, a mode setting unit 92, a first supply control unit 93, a second supply control unit 94, a second standard value setting unit 95, a coverage rate calculating unit 96 which serves as a toner consumption amount calculating unit, and a development drive time calculating unit 97.

When printing an original image, the print control unit 91 controls respective portions of the printer 1

First, an operation of the print control unit 91 to cause the printer 1 to print the original image will be described. In a following description, a case where a toner image is formed on a single side of the sheet K will be described.

First, the print control unit 91 stores image data received via the interface unit 70 in the storage unit 80 temporarily. The print control unit 91 controls the paper feeding unit 10, the image forming unit 30 and the fixing unit 40 to form toner image on the sheet K based on image data stored temporarily in the storage unit 80. The print control unit 91 drives the first feeding roller 11 or the second feeding roller 12 to convey the sheet K to the image forming unit 30.

Further, the print control unit 91 supplies data for forming a toner image which is generated based on the image data to the laser scanner unit 33. The print control unit 91 forms an electrostatic latent image on the photosensitive drum 31 with laser beam emitted from the laser scanner unit 33. The print control unit 91 forms a toner image on the photosensitive drum 31 from the developing unit 34 and transfers this toner image to the sheet K by means of the transfer roller 38. The print control unit 91 controls the heating rotating body 41 to be heated at a predetermined temperature, causes the heating rotating body 41 to melt toner of the toner image transferred to the sheet K and then, causes the pressure rotating body 42, which the heating rotating body 41 makes pressure contact with, to fix the toner to the sheet K. Further, the print control unit 91 controls the paper feeding unit 10 to discharge the sheet K on which a toner image is fixed from the paper discharge unit 16.

The print control unit 91 controls bias voltage to be applied to each roller from the first voltage applying unit, the second voltage applying unit and the third voltage applying unit (not shown). The first voltage applying unit applies a first bias voltage to the magnetic roller 342 based on a control signal output from the control unit 90. The second voltage applying unit applies a second bias voltage to the developing roller 343 based on a control signal output from the control unit 90. The third voltage applying unit applies a third bias voltage to the photosensitive drum 31 based on a control signal output from the control unit 90.

Toner adhering to the surface of the magnetic roller 342 is moved to the developing roller 343 due to difference in potential between the first bias voltage applied to the magnetic roller 342 and the second bias voltage applied to the developing roller 343 (hereinafter referred to as "development bias voltage"). The amount of toner which is moved from the magnetic roller 342 to the developing roller 343 increases in proportion to the development bias voltage generated between the magnetic roller 342 and the developing roller 343.

Toner adhering to the surface of the developing roller 343 is moved to the surface of the photosensitive drum 31 due to difference in potential generated between the photosensitive drum 31 and the developing roller 343. The electrostatic latent image formed on the surface of the photosensitive drum 31 is developed (visualized) with toner. The amount of toner moved from the developing roller 343 to the photosensitive drum 31 increases in parallel to difference in potential generated between the developing roller 343 and the photosensitive drum 31.

In the touch-down type developing unit 34, the second bias voltage supplied to the developing roller 343 is controlled to a fixed value. In addition, difference in potential between the first bias voltage supplied to the magnetic roller 342 and the third bias voltage supplied to the photosensitive drum 31 is controlled to be constant. The print control unit 91 controls difference in potential between the developing roller 343 and the magnetic roller 342 to adjust the amount of toner to be moved.

Next, the mode setting unit 92, the first supply control unit 93, the second supply control unit 94, and the second standard value setting unit 95 will be described.

The mode setting unit 92 determines whether supply of toner is necessary. When the mode setting unit 92 determines that supply of toner is necessary, it determines which of toner normal supply mode or toner forced supply mode should be executed, depending on toner density detected by the toner density sensor 39.

If toner density (toner density value TN) detected by the toner density sensor 39 is more than the first standard value $TN_{th1}$, the mode setting unit 92 determines that supply of toner is not necessary. In this case, the mode setting unit 92 does not determines which should be executed the toner normal supply mode or the toner forced supply mode.

On the other hand, if toner density (toner density value TN) detected by the toner density sensor 39 is less than the first standard value $TN_{th1}$ and more than a second standard value $TN_{th2}$ which is lower than the first standard value $TN_{th1}$, the mode setting unit 92 sets the toner normal supply mode (first developer supply mode) as a mode for supplying developer to the developing unit 34. The toner normal supply mode will be described below.

If toner density (toner density value TN) detected by the toner density sensor 39 is less than the second standard value $TN_{th2}$, the mode setting unit 92 sets the toner forced supply mode (second developer supply mode) as a mode for supplying developer to the developing unit 34. The toner forced supply mode will be described below.

The first standard value $TN_{th1}$ and the second standard value $TN_{th2}$ are stored in the storage unit 80. The mode setting unit 92 acquires data of the first standard value $TN_{th1}$ and/or the second standard value $TN_{th2}$ stored in the storage unit 80. Then, the mode setting unit 92 determines whether the toner density value TN detected by the toner density sensor 39 is the first standard value $TN_{th1}$ or more, whether the toner density value TN detected by the toner density sensor 39 is less than the first standard value $TN_{th1}$ and the second standard value $TN_{th2}$ or more, and whether the toner density TN detected by the toner density sensor 39 is less than the second standard value $TN_{th2}$. Data about a determination result (toner normal supply mode, toner forced supply mode) by the mode setting unit 92 is stored in the storage unit 80.

When toner normal supply mode is set as a toner supply mode in the mode setting unit 92, the first supply control unit 93 executes the toner normal supply mode. The toner normal supply mode is a mode which prior to (or after) printing of an original image, controls the toner supply unit 371 to supply developer accommodated in the toner cartridge 37 to the developing unit 34.

When toner forced supply mode is set as a toner supply mode in the mode setting unit 92, the second supply control unit 94 executes the toner forced supply mode. The toner forced supply mode is a mode which when toner density detected by the toner density sensor 39 is less than the second standard value during printing of the original image, interrupts development of electrostatic latent image by the developing unit 34. The toner forced supply mode is a mode which controls the toner supply unit 371 to supply developer accommodated in the toner cartridge 37 to the developing unit 34.

This toner forced supply mode is executed when toner density drops extremely because of continuous printing of images with a high coverage rate. The toner forced supply mode takes a longer time to supply toner than the toner normal supply mode because it is necessary to bring back the toner density which has dropped extremely to a normal toner density. During this period, the printer 1 cannot print any original image, thereby convenience and productivity decrease. Further, agitation of toner is repeated until the toner density which has dropped extremely is brought back to normal toner density and thereby deterioration of toner is progressed. Thus, in the printer 1, it is desirable not to execute the toner forced supply mode except when unavoidable.

The second standard value setting unit 95 calculates a toner consumption speed in the developing unit 34. The second standard value setting unit 95 sets a second standard value corresponding to the toner consumption speed. More specifically, the second standard value setting unit 95 calculates a toner consumption speed in the developing unit 34 at a predetermined interval. As the calculated toner consumption speed increases, the second standard value setting unit 95 sets the second standard value to be a lower value and as the toner consumption speed in the developing unit 34 decreases, sets the second standard value to be a higher value.

The second standard value setting unit 95 of the present embodiment calculates the toner consumption speed TV each time when an original image is printed. The second standard value setting unit 95 sets the second standard value $TN_{th2}$ which is stored in the storage unit 80 (rewrites data) based on this toner consumption speed TV.

When calculating the toner consumption speed TV, the second standard value setting unit 95 divides a total sum $P_{(i)}$ of a coverage rate P calculated by the coverage rate calculating unit 96 (which will be described below) by a total sum $T_{(i)}$ of development drive times T calculated by the development drive time calculating unit 97 (which will be described below). A value obtained by this division is calculated as the toner consumption speed TV.

More specifically, the second standard value setting unit 95 calculates an average toner consumption speed $TV_{ave}$ of (n−m+1) sheets from m sheet up to n sheet in accordance with Equation (1) below.

[Equation 1]

Each time when the average toner consumption speed $TV_{ave}$ is calculated, the second standard value setting unit 95 erases data about the oldest coverage rate P and development drive time T used last time and adds data about the newest coverage rate P and development drive time T acquired this time (moving average processing). For example, the second standard value setting unit 95 erases data about the oldest coverage rate $P_{(m-2)}$ and development drive time $T_{(m-2)}$ used last time in Equation 1, and adds data about the newest coverage rate $P_{(n)}$ and development drive time $T_{(n)}$ acquired this time.

When printing images with a low coverage rate continuously after printing images with a high coverage rate continuously, executing the above-described moving average processing raises gradually the second standard value $TN_{th2}$ which serves as a reference value for toner forced supply without increasing it rapidly. Likewise, when printing images with a high coverage rate after printing images with a low coverage rate, the second standard value $TN_{th2}$ which serves as a reference value for the toner forced supply drops gradually without dropping rapidly. A specific example of a case where the second standard value setting unit 95 sets the second standard value corresponding to the toner consumption speed TV will be described below.

Further, after calculating the toner consumption speed TV, the second standard value setting unit 95 sets the second standard value $TN_{th2}$ stored in the storage unit 80 depending on a difference between the toner consumption speed TV calculated this time and a toner consumption speed TV' calculated last time.

More specifically, if the toner consumption speed TV calculated this time is more than the toner consumption speed TV' calculated last time, as a difference between the toner consumption speed TV calculated this time and the toner consumption speed TV' calculated last time increases (as the toner consumption speed increases), the second standard value setting unit 95 sets the second standard value $TN_{th2}$ stored in the storage unit 80 to be lower value.

On the other hand, if the toner consumption speed TV calculated this time is less than the toner consumption speed TV' calculated last time, as the difference between the toner consumption speed TV calculated this time and the toner consumption speed TV' calculated last time decreases (as the toner consumption speed decreases), the second standard value setting unit 95 sets the second standard value $TN_{th2}$ to be a higher value.

Like this, the second standard value $TN_{th2}$ stored in the storage unit 80 is set depending on a difference between the toner consumption speed TV calculated this time and the toner consumption speed TV' calculated last time.

Next, the coverage rate calculating unit 96 and the development drive time calculating unit 97 will be described below.

The coverage rate calculating unit 96 calculates a coverage rate P. The coverage rate P indicates an area of an image per predetermined area (print range of the sheet K) of each original image based on image data acquired by the interface unit 70. In the present embodiment, the coverage rate calculating unit 96 calculates an amount of toner consumption in last printed n sheets of toner images developed in the developing unit 34. More specifically, each time when an original image is printed, the coverage rate calculating unit 96 calculates a total sum $P_{(i)}$ about $P_{(m-1)}$, $P_{(m)}$, $P_{(m+1)}$, $P_{(m+2)}$, $P_{(m+3)}$, $P_{(m+4)}$, . . . $P_{(n-1)}$, $P_{(n)}$ of (n−m+1) sheets from m sheet up to n sheet (see Equation 1). Data about the coverage rate P calculated by the coverage rate calculating unit 96 is stored in the storage unit 80.

The development drive time calculating unit 97 calculates a development drive time T. The development drive time T is a time for the developing unit 34 to take to develop an electrostatic latent image of a single image formed on the photosensitive drum 31. In the present embodiment, the development drive time calculating unit 97 counts a drive time required by a drive motor (not shown) which provides the developing roller 343 with a rotation force to develop a single original image and a total sum of the drive times is regarded as development drive time T. More specifically, each time when an original image is printed, the development drive time calculating unit 97 calculates a total sum $T_{(i)}$ about $T_{(m-1)}$, $T_{(m)}$, $T_{(m+1)}$, $T_{(m+2)}$, $T_{(m+3)}$, $T_{(m+4)}$, . . . $T_{(n-1)}$, $T_{(n)}$ of (n−m+1) sheets from m sheet up to n sheet (see Equation 1). Data about the development drive time T calculated by the development drive time calculating unit 97 is stored in the storage unit 80.

Next, a processing procedure for setting toner normal supply mode or toner forced supply mode in the control unit 90 (mode setting unit 92) will be described with reference to a flow chart of FIG. 3. The processing of the flow chart shown in FIG. 3 is executed repeatedly at a predetermined time interval during an operation of the printer 1.

Figure 3:
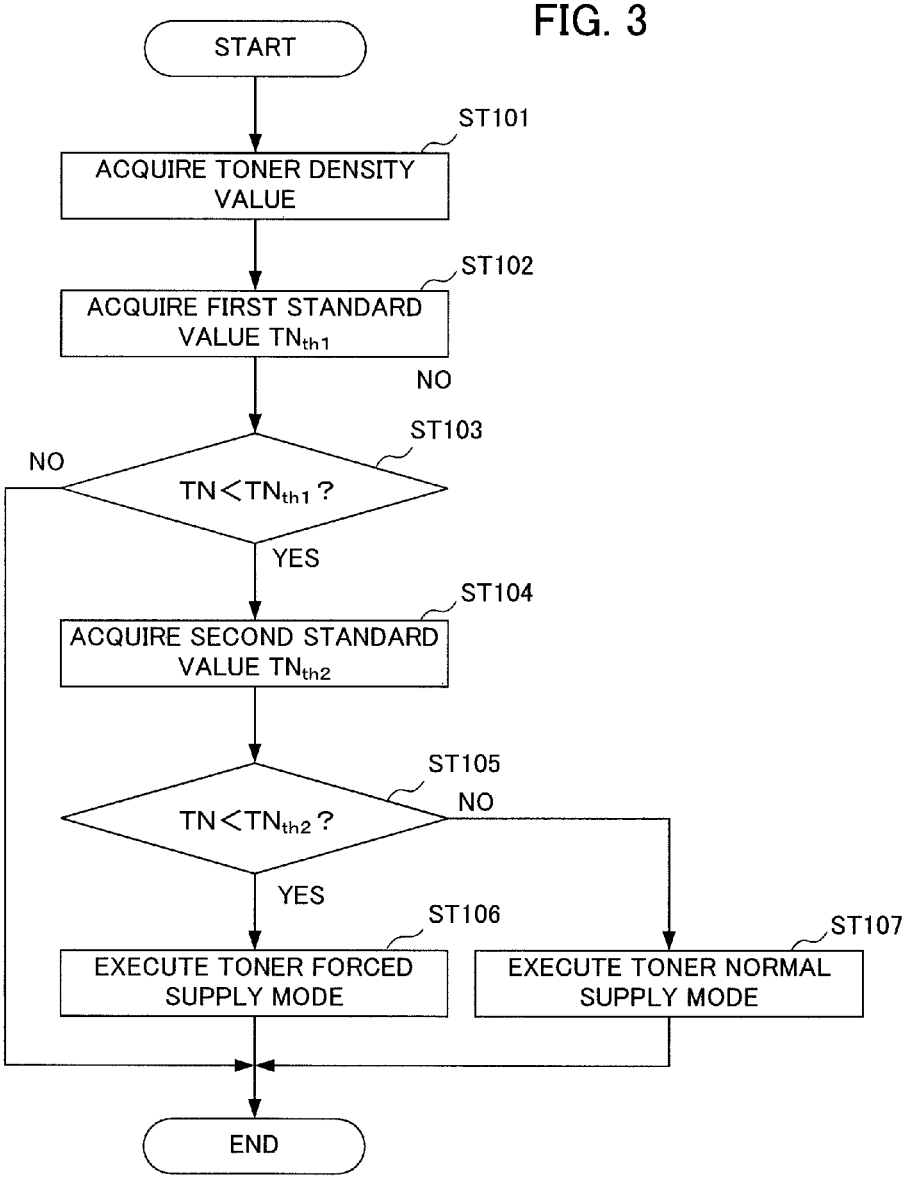
FIG. 3 is a flow chart showing a processing procedure for executing toner normal supply mode or toner forced supply mode in a control unit 90.

In step ST101 in FIG. 3, the control unit 90 (mode setting unit 92) acquires data about the toner density value TN detected by the toner density sensor 39 from the storage unit 80.

In step ST102, the control unit 90 (mode setting unit 92) acquires data about the first standard value $TN_{th1}$ from the storage unit 80.

In step ST103, the control unit 90 (mode setting unit 92) determines whether the toner density value TN is less than the first standard value $TN_{th1}$ ($TN<TN_{th1}$). In step ST102, when the control unit 90 (mode setting unit 92) determines that the toner density value TN is less than the first standard value $TN_{th1}$ (YES), it brings the processing forward to step ST104. In step ST102, when the control unit 90 (mode setting unit 92) determines that the toner density value TN is not less than the first standard value $TN_{th1}$ (NO), it terminates a processing of this flow chart for executing the toner normal supply mode or the toner forced supply mode. The reason is that when the toner density value TN is the first standard value $TN_{th1}$ or more, any one of the toner normal supply mode and the toner forced supply mode does not have to be executed.

In step ST104 (step ST103: YES), the control unit 90 (mode setting unit 92) acquires data about the second standard value $TN_{th2}$ from the storage unit 80. This second standard value $TN_{th2}$ is a value which is set by the control unit 90 (second standard value setting unit 95) which will be described below, corresponding to toner consumption speed S.

In step ST105, the control unit 90 (mode setting unit 92) determines whether the toner density value TN is less than the second standard value $TN_{th2}$ ($TN<TN_{th2}$). In this step ST105, when the control unit 90 (mode setting unit 92) determines that the toner density value TN is less than the second standard value $TN_{th2}$ (YES), it brings the processing forward to step ST106. Further, in step ST105, when the control unit 90 (mode setting unit 92) determines that the toner density value TN is not less than the first standard value $TN_{th1}$ (NO), it brings the processing forward to step ST107.

In step ST106 (step ST105: YES), the control unit 90 (second supply control unit 94) executes the toner forced supply mode. The toner forced supply mode is a mode which interrupts development of an electrostatic latent image by the developing unit 34 and controls the toner supply unit 371 to supply developer accommodated in the toner cartridge 37 to the developing unit 34. When the processing of step ST106 is terminated, the control unit 90 (second supply control unit 94) terminates a processing of this flow chart for executing the toner normal supply mode or the toner forced supply mode.

When the toner forced supply mode is set in the above-mentioned step ST106, the control unit 90 (second supply control unit 94) executes the toner forced supply mode.

On the other hand, in step ST107 (step ST105: NO), the control unit 90 (mode setting unit 92) sets the toner normal supply mode as a mode for supplying toner to the developing unit 34. The toner normal supply mode is a mode which prior to (or after) printing of an original image, controls the toner supply unit 371 to supply developer accommodated in the toner cartridge 37 to the developing unit 34. When the processing of step ST107 is terminated, the control unit 90 (mode setting unit 92) terminates a processing of this flow chart for setting the toner normal supply mode or the toner forced supply mode.

When the toner normal supply mode is set in the above-described step ST107, the control unit 90 (first supply control unit 93) executes the toner normal supply mode.

Next, a processing procedure in a case for setting the second standard value $TN_{th2}$ in the control unit 90 (second standard value setting unit 95) will be described with reference to the flow chart of FIG. 4. The processing of the flow chart shown in FIG. 4 is executed repeatedly each time when printing of an original image terminates during an operation of the printer 1.

Figure 4:
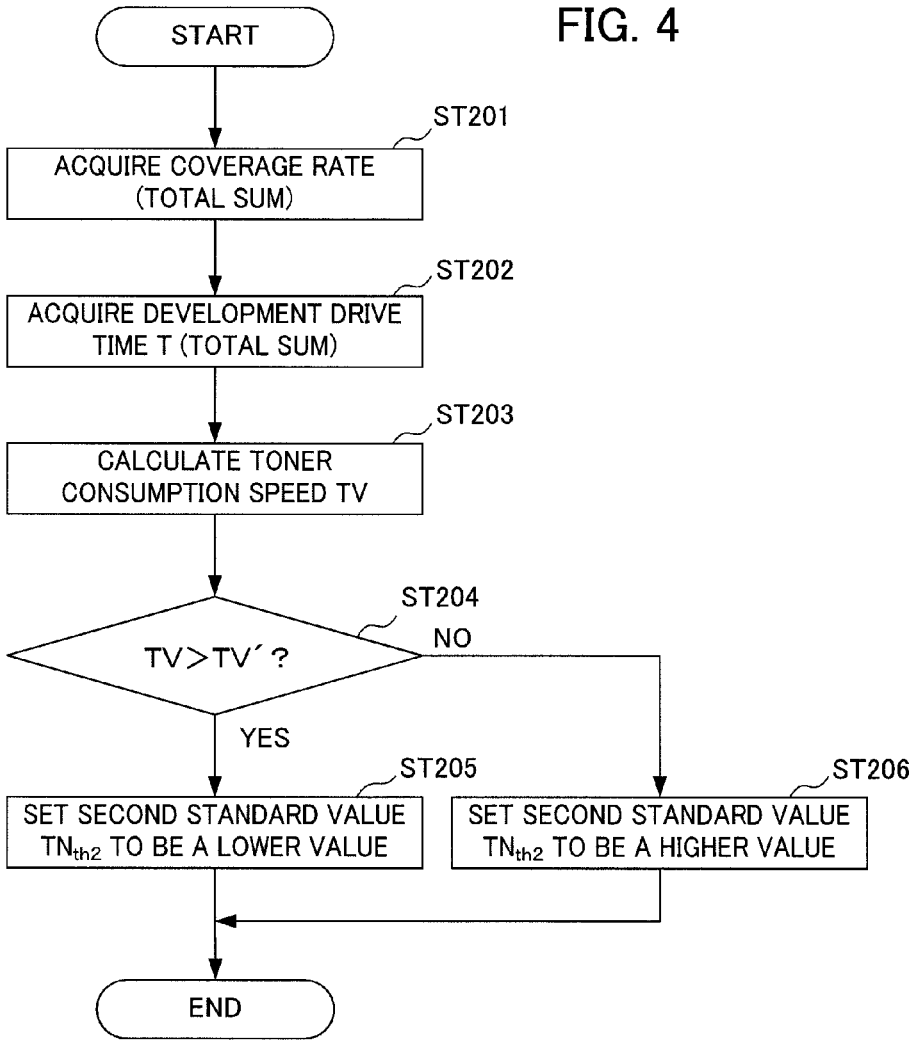
FIG. 4 is a flow chart showing a processing procedure when a second standard value $TN_{th2}$ is set in the control unit 90.

In step ST201 shown in FIG. 4, the control unit 90 (second standard value setting unit 95) acquires data about a coverage rate P (total sum $P_{(i)}$) of most recently printed n sheets calculated by the coverage rate calculating unit 96.

In step ST202, the control unit 90 (second standard value setting unit 95) acquires data about a development drive time T (total sum $T_{(i)}$) of most recently printed n sheets calculated by the development drive time calculating unit 97.

In step ST203, the control unit 90 (second standard value setting unit 95) calculates a toner consumption speed TV. The toner consumption speed TV is calculated by dividing the coverage rate P acquired in step ST201 by the development drive time T acquired in step ST202.

In step ST204, the control unit 90 (second standard value setting unit 95) determines whether the toner consumption speed TV calculated this time is the toner consumption speed TV' calculated last time or more. In this step ST204, if the control unit 90 (second standard value setting unit 95) determines that the toner consumption speed TV calculated this time is the toner consumption speed TV' calculated last time or more (TV≥TV') (YES), it brings the processing forward to step ST205. In step ST204, if the control unit 90 (second standard value setting unit 95) determines that the toner consumption speed TV calculated this time is not the toner consumption speed TV' calculated last time or more (NO), it brings the processing forward to step ST206.

In step ST205 (step ST204: YES), the control unit 90 (second standard value setting unit 95) sets the second standard value $TN_{th2}$ stored in the storage unit 80 to be a lower value, corresponding to a difference between the toner consumption speed TV calculated this time and the toner consumption speed TV' calculated last time. Like this, the control unit 90 (second standard value setting unit 95) sets the second standard value $TN_{th2}$ to be a lower value as the toner consumption speed TV increases. When the processing of step ST205 is terminated, the control unit 90 (second standard value setting unit 95) terminates the processing of this flow chart for setting the second standard value $TN_{th2}$.

On the other hand, in step ST206 (step ST204: NO), the control unit 90 (second standard value setting unit 95) sets the second standard value $TN_{th2}$ stored in the storage unit 80 to be a higher value corresponding to a difference between the toner consumption speed TV calculated this time and the toner consumption speed TV' calculated last time. Like this, the control unit 90 (second standard value setting unit 95) sets the second standard value $TN_{th2}$ to be a higher value as the toner consumption speed TV decreases. When the processing of step ST206 is terminated, the control unit 90 (second standard value setting unit 95) terminates the processing of this flow chart for setting the second standard value $TN_{th2}$.

Next, a result of an experiment for measuring whether the toner forced supply mode was activated using a printer A (which will be described below) of a conventional example and a printer of the present embodiment will be described. In this experiment, 10 sheets of A4 size whose coverage rate was 80% and 10 sheets of A4 size whose coverage rate was 10% were printed alternately (in order of 80%, 10%, 80%, 10%), and totally 40 sheets were printed. During printing of 40 sheets, whether there was a change in toner density detected by the toner density sensor of each printer and whether the mode was changed to the toner forced supply mode were measured.

When the toner density drops below a toner density control standard value, the printer A of the conventional example executes the toner forced supply mode. On the other hand, to calculate the toner consumption speed TV in the printer of the present embodiment, the coverage rate P (total sum $P_{(i)}$) and the development drive time T (total sum $T_{(i)}$) of most recently printed 10 sheets were used.

Figure 5A:
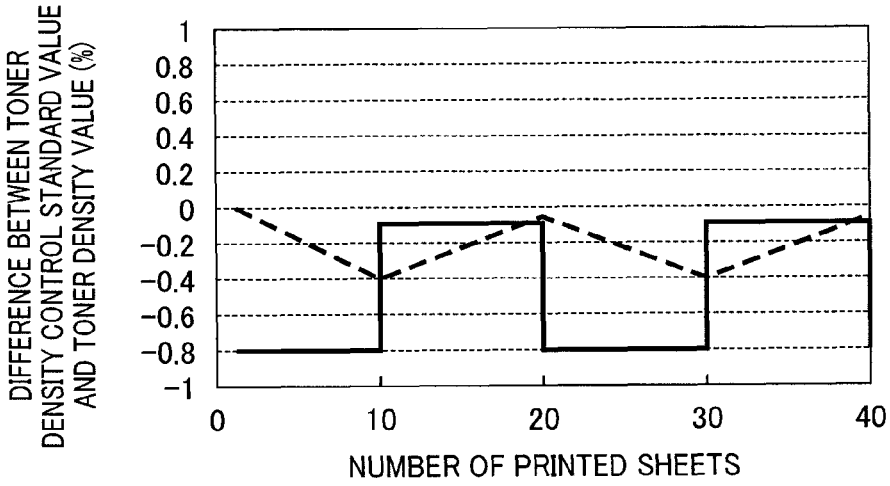
FIG. 5A is a graph showing a result of an experiment performed on a printer of conventional example.
Figure 5B:
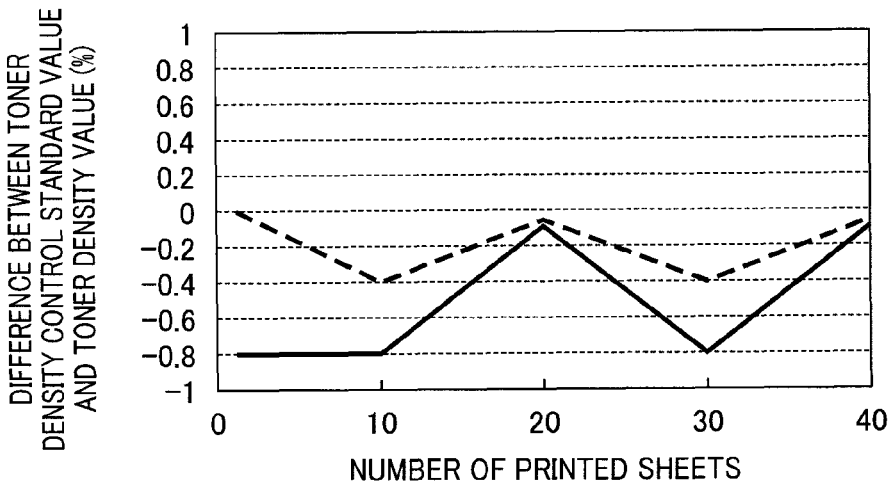
FIG. 5B is a graph showing a result of experiment performed on a printer of the present embodiment.

FIG. 5A is a graph showing the experimental results of the printer A of the conventional example. FIG. 5B is a graph showing the experimental results of the printer 1 of the present embodiment. In each graph, the abscissa axis indicates a number of printed sheets and the ordinate axis indicates a difference (%) between the toner density control standard value and an actually detected toner density value (hereinafter, the value on the ordinate axis is referred to as "toner density control standard value" also.) In each graph, its solid line indicates a progress in toner density control standard value and its broken line indicates a progress in toner density value.

As shown in FIG. 5A, in the printer A of the conventional example, when the coverage rate changed from 80% to 10%, the toner density control standard value rose rapidly. At this time, the toner density value dropped below the toner density control standard value in the printer A of the conventional example. Consequently, at the $10^{th}$ sheet and $30^{th}$ sheet in printing when the coverage rate changed from 80% to 10%, the toner force supply mode which was not necessary was executed.

On the other hand, as shown in FIG. 5B, when the coverage rate changed from 80% to 10% in the printer 1 of the present embodiment, the toner density control standard value did not rise rapidly. After that, the toner density control standard value rose gradually. The reason is that the printer 1 of the present embodiment uses the coverage rate (total sum $P_{(i)}$) of most recently printed 10 sheets to calculate the toner consumption speed TV. Thus, even when the coverage rate changed from 80% to 10%, a rapid change in coverage rate is difficult to reflect on a calculation result of the toner consumption speed TV. Thus, in the printer 1 of the present embodiment, when the coverage rate changed from 80% to 10%, the toner density value never dropped below the toner density control standard value. As a result, in the printer 1 of the present embodiment, at $10^{th}$ sheet and $30^{th}$ sheet in printing when the coverage rate changed from 80% to 10%, the toner forced supply mode was not executed but the toner normal supply mode was executed.

In the meantime, in the printer 1 of the present embodiment also, it can be considered that the toner consumption amount (coverage rate) may increase abnormally so that the toner density value may drop below the toner density control standard value (second standard value $TN_{th2}$). For example, in FIG. 5B, when the toner density value rises abnormally around the $20^{th}$ sheet in printing, the toner density value can drop below the toner density control standard value. In this case, the toner forced supply mode is executed in the printer 1 like the printer A of the conventional example. However, in the printer 1 of the present embodiment, the frequency of executing the toner forced supply mode can be reduced compared to the printer A of the conventional example.

On the other hand, as a measure for reducing the frequency of executing the toner forced supply mode because the toner consumption amount (coverage rate) increases abnormally, it is permissible to add a correction value (constant) to the toner consumption speed $TV_{ave}$ calculated with Equation (1). By adding the correction value to the toner consumption speed $TV_{ave}$, the second standard value $TN_{th2}$ set by the control unit 90 (second standard value setting unit 95) can be kept at a relatively high value. As a result, toner consumption of the printer 1 increases abnormally so that the toner density value drops below the toner density control standard value thereby the frequency of executing the toner forced supply mode is reduced further.

In addition, it is permissible to prepare two correction value $\alpha$ and $\beta$ ($\alpha<\beta$) and change the correction value depending on data accumulation amount. For example, if data corresponding to (n−m+1) sheets is accumulated in the storage unit 80, the control unit 90 (second standard value setting unit 95) adds the correction value a to the toner consumption speed $TV_{ave}$. Unless data corresponding to (n−m+1) is accumulated in the storage unit 80, the control unit 90 (second standard value setting unit 95) adds the correction value $\beta$ to the toner consumption speed $TV_{ave}$. If the toner consumption amount increases rapidly when no data corresponding to (n−m+1) sheets is accumulated in the storage unit 80, its influence is greatly reflected on the toner consumption speed $TV_{ave}$ calculated according to Equation (1). Thus, if no data corresponding to the (n−m+1) sheets is accumulated in the storage unit 80, the control unit 90 (second standard value setting unit 95) adds a larger correction value $\beta$ to the toner consumption speed $TV_{ave}$. As a result, a possibility that the toner density value may drop below the toner density control standard value can be reduced further.

Further, the correction value may be obtained by executing an experiment of causing a printer to actually print images having a different coverage rate continuously. The correction value may be obtained according to a simulation based on a variety of parameters such as operation condition. In addition, a plurality of the correction values may be prepared depending on a data accumulation amount.

The printer 1 of the above-described present embodiment provides a following advantage.

In the printer 1 of the present embodiment, the control unit 90 (second standard value setting unit 95) calculates a toner consumption speed in the developing unit 34. Then, as the calculated toner consumption speed increases, the control unit 90 sets the second standard value which serves as the toner density control standard value to be a lower value and as the toner consumption speed in the developing unit 34 decreases, sets the second standard value to be a higher value.

Consequently, when images are printed continuously regardless of the coverage rate, the toner consumption speed of the printer 1 increases. Thus, the second standard value which serves as the toner density control standard value is set to be a lower value. Thus, if the printer 1 is caused to print images continuously regardless of the coverage rate, a situation in which toner is not supplied to meet consumption of toner can be avoided.

Further, when the coverage rate of the printer 1 is changed from an image having a high coverage rate to an image having a low coverage rate, the second standard value which serves as the toner density control standard value never rises rapidly. Thus, the printer 1 can avoid an event that the toner forced supply mode may be executed although print action of the printer 1 does not have to be stopped, thereby stopping the print action, to a possible extent.

Further, when the print speed is slow, the development drive time T (denominator of Equation (1)) of the printer 1 is increased even for an image having a high coverage rate, a calculated value of the toner consumption speed is decreased. Thus, even for an image having a high coverage rate, the second standard value which serves as the toner density control standard value is set to be a low value. Therefore, the printer 1 can avoid an event that when an image having a high coverage rate is presented and the print speed is slow, the toner forced supply mode may be executed although the print action of the printer 1 does not have to be stopped so that the print action is stopped, to a possible extent.

In the printer 1, when images having a high coverage rate are printed continuously, the second standard value rises gradually. Thus, if an image having an ordinary coverage rate is printed next, the toner density never rises so much. As a result, even if an image having a high coverage rate is changed to an image having an ordinary coverage rate, the printer 1 can suppress generation of fogging on a white background.

Therefore, the printer 1 can adjust the toner density of the developing unit 34 corresponding to a toner consumption amount.

As a function of a toner consumption amount calculating unit, the control unit 90 calculates a toner consumption amount of a toner image developed by the developing unit 34 based on image data of an electrostatic latent image formed on the surface of the photosensitive drum 31. Further, the control unit 90 (development drive time calculating unit 97) calculates a development drive time taken for developing a toner image in the developing unit 34. Then, the control unit 90 (second standard value setting unit 95) calculates a toner consumption speed. The toner consumption speed is calculated by dividing a toner consumption amount calculated by a function of the toner consumption amount calculating unit by a development drive time calculated by a function of the development drive time calculating unit 97. Thus, the printer 1 can calculate the toner consumption speed when a toner image is developed by the developing unit 34 accurately.

Further, the control unit 90 calculates a coverage rate indicating an area of an image per a predetermined area. As the toner consumption amount, this calculation is performed by a function of the toner consumption amount calculating unit based on image data of an electrostatic latent image formed on the surface of the photosensitive drum 31. Thus, the printer 1 can calculate toner consumption amount of a toner image developed by the developing unit 34 more accurately.

In some case, after images having a high coverage rate are printed continuously, images having a low coverage rate are printed. In other case, after images having a low coverage rate are printed continuously, images having a high coverage rate are printed continuously. Even in such a case, the control unit 90 calculates an average coverage rate of n sheets last printed by a function of the toner consumption calculating unit (coverage rate calculating unit 96). Thus, the second standard value which serves as the toner density control standard value never rises or drops rapidly. Thus, it is possible to avoid an event that when printing is changed to printing of images having a different coverage rate, a detected toner density value drops below the second standard value so that the toner forced supply mode is executed unexpectedly, thereby stopping the print action.

Although the disclosed embodiments have been described above, the present disclosure is not restricted to the above-described embodiments but may be carried out in a variety of other embodiments.

In the present embodiment, an example of calculating an average coverage rate of most recently printed n sheets as a toner consumption amount has been described. The present disclosure is not restricted to this example, but it is permissible to calculate an average coverage rate in most recent time interval t of printed images.

In the present embodiment, an example that the two-component developer was used as the developer and a magnetic permeability sensor was used as the toner density sensor 39 has been described. Thus, in the printer 1, toner density of developer accommodated in the developing unit 34 can be detected accurately. Further, in the printer 1, fluctuation in detected toner density can be reduced. However, the toner density sensor 39 can be set appropriately depending on a toner component and configuration of the printer 1. Further, the sensor for use is not restricted to the magnetic permeability sensor. For example, if one-component developer composed of only magnetic toner is used as developer, a piezoelectric sensor, an optical sensor or the like may be used.

The embodiment of the image forming apparatus concerned with the present disclosure is not restricted to the above-described printer 1. That is, the image forming apparatus of the present disclosure may be applied to a copying machine, a facsimile, and a multi-function peripheral containing functions of the copying machine, facsimile and printer.

The invention claimed is:

1. An image forming apparatus comprising: an image bearing member on the surface of which an electrostatic latent image is formed;

an electrostatic latent image forming unit that forms an electrostatic latent image on the surface of the image bearing member;

a developer accommodating unit that accommodates developer containing at least toner;

a developing unit that supplies toner to the image bearing member and develops the electrostatic latent image as toner image;

a developer supply unit that supplies the developer accommodated in the developer accommodating unit to the developing unit;

a toner density detecting unit that detects toner density in the developing unit;

a mode setting unit that when toner density detected by the toner density detecting unit is less than a first standard value and a second standard value that is lower than the first standard value or more, sets a first developer supply mode as a mode for supplying developer to the developing unit and when the toner density detected by the toner density detecting unit is less than the second standard value, sets a second developer supply mode as a mode for supplying developer to the developing unit;

a first supply control unit that when the first developer supply mode is set by the mode setting unit, controls the developer supply unit to supply developer accommodated in the developer accommodating unit to the developing unit;

a second supply control unit that when the second developer supply mode is set by the mode setting unit, interrupts development of the electrostatic latent image by the developing unit and controls the developer supply unit to supply the developer accommodated in the developer accommodating unit to the developing unit; and a second standard value setting unit that calculates toner consumption speed in the developing unit, sets the second standard value to be a lower value as the toner consumption speed increases, and sets the second standard value to be a higher value as the toner consumption speed decreases.

2. The image forming apparatus according to claim 1, further comprising: a toner consumption calculating unit that calculates a toner consumption amount of a toner image developed by the developing unit based on image data of the electrostatic latent image formed on the surface of the image bearing member; and a development drive time calculating unit that calculates a development drive time taken for the developing unit to develop the toner image, wherein the second standard value setting unit calculates the toner consumption speed by dividing the toner consumption amount calculated by the toner consumption amount calculating unit by the development drive time calculated by the development drive time calculating unit.

* * * * *